United States Patent [19]

Schuster

[11] 4,353,300

[45] Oct. 12, 1982

[54] INKING SYSTEM FOR ROTARY OFFSET PRINTING MACHINE

[75] Inventor: Georg Schuster, Augsburg, Fed. Rep. of Germany

[73] Assignee: M.A.N.-Roland Druckmaschinen Aktiengesellschaft, Offenbach-am-Main, Fed. Rep. of Germany

[21] Appl. No.: 225,132

[22] Filed: Jan. 14, 1981

[30] Foreign Application Priority Data

Dec. 13, 1979 [DE] Fed. Rep. of Germany ..... 2950163

[51] Int. Cl.[3] ..... B41F 31/02

[52] U.S. Cl. ..... 101/365

[58] Field of Search ..... 101/364, 365, 363

[56] References Cited

U.S. PATENT DOCUMENTS

| | | | |
|---|---|---|---|
| 1,825,999 | 10/1961 | Fankboner . | |
| 2,210,243 | 8/1940 | Huck | 101/365 |
| 2,479,822 | 8/1949 | Enkur et al. | 198/165 |
| 3,559,573 | 2/1971 | Hantscho | 101/365 |
| 3,589,288 | 6/1971 | Lake | 101/363 |
| 3,922,966 | 12/1975 | Despot | 101/365 X |
| 4,050,380 | 9/1977 | Pfizenmaier | 101/365 |
| 4,058,058 | 11/1977 | Hantscho | 101/364 X |
| 4,089,264 | 5/1978 | Jeschke et al. | 101/365 |
| 4,242,958 | 1/1981 | Jeschke | 101/365 |

*Primary Examiner*—Richard J. Apley
*Assistant Examiner*—David J. Isabella
*Attorney, Agent, or Firm*—Frishauf, Holtz, Goodman & Woodward

[57] ABSTRACT

To prevent escape of ink from a backing plate of an ink trough in which a duct roller is rotatably positioned, a flexible element, for example of plastic, in the form of an elongated rail with two extending plate portions, is connected, respectively, to the backing plate and to the doctor blade, for example by adhesion to the doctor blade and by clamping with a clamping rail to the backing plate, thus permitting removal of the doctor blade together with the plastic element for replacement of the doctor blade. The adjustment mechanism, preferably utilizing adjustment screws having threads of opposite direction of rotation in different positions in a threading block and a threading plate attached to the doctor blade, provides for accurate adjustment, protected against contamination by the ink by the plastic element bridging any gap between the backing plate and the doctor blade, while permitting respective zone adjustment of the position of the doctor blade with respect to the duct roller.

12 Claims, 2 Drawing Figures

INKING SYSTEM FOR ROTARY OFFSET PRINTING MACHINE

Figure 1:
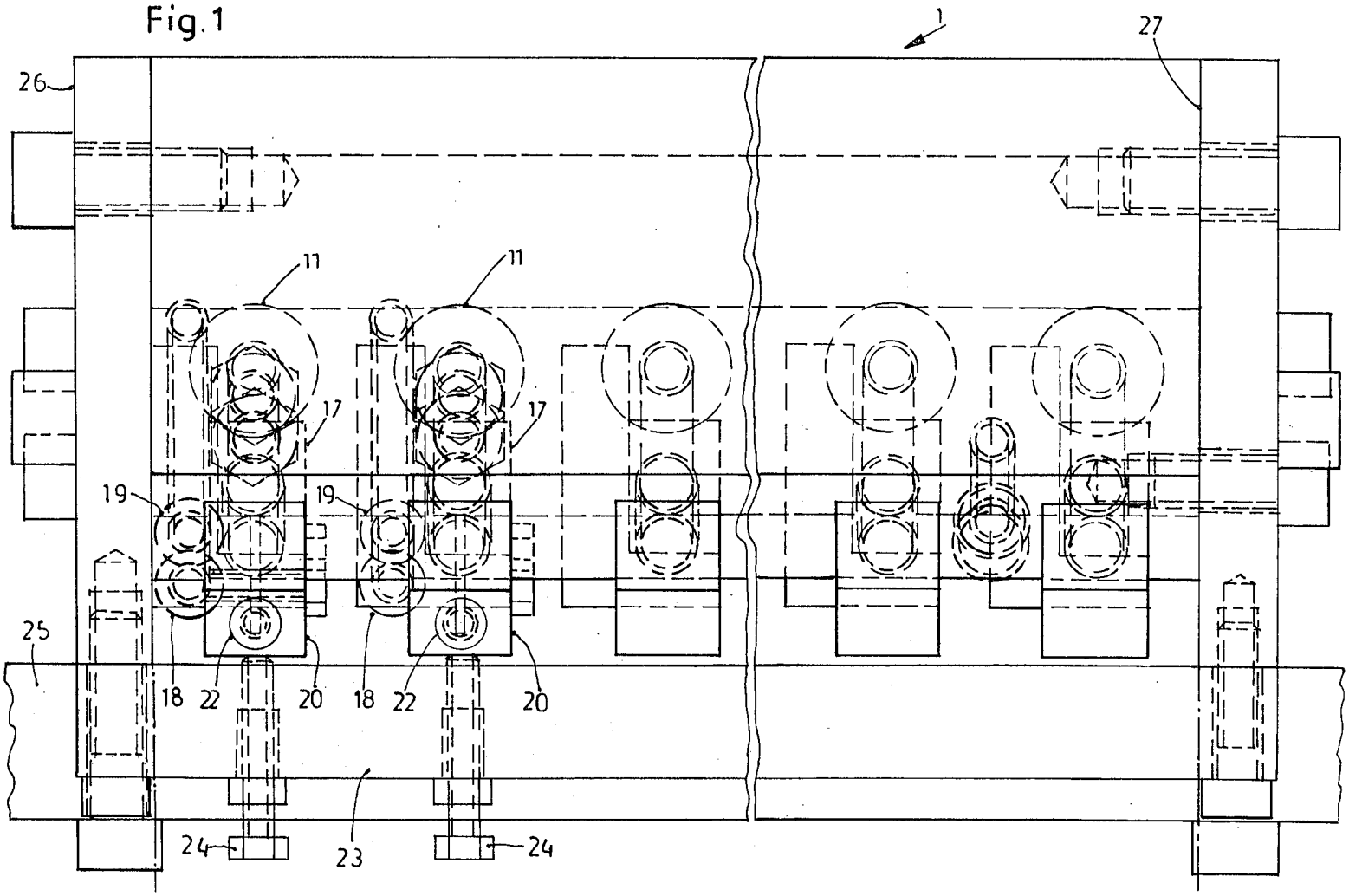

The present invention relates to an inking system for rotary offset printing machines, and more particularly to an inking system in which a duct roller is rotatable in an ink trough, and a doctor blade is provided to adjust and meter the thickness of the film of ink which will be picked up by the doctor blade from the ink in the trough.

BACKGROUND AND PRIOR ART

Various types of inking systems for printing machines use troughs in which a doctor blade can be adjusted in longitudinal position with respect to the gap or nip between the blade and the inking trough. Usually, adjustment screws are provided, set along the length of the doctor blade in the inking system, and engaging the doctor blade so that the doctor blade can be pressed against the duct roller at various locations, independently of the position of the blade with respect to adjacent locations, so that the thickness of the ink film picked up by the duct roller can be adjusted in zones extending axially across the duct roller (see, for example, German Pat. No. 863,346). In some arrangements of this type, a double-armed lever is positioned between the adjustment screws and control rods engaging, or coupled to, the doctor blades. The various levers are engaged by cams which are positioned on a shaft common to the levers and which can be rotated by a hand crank or the like.

It has been found that ink systems of this type are subject to contamination by ink which penetrates between the doctor blade and the backing plate or ink bottom plate of the ink trough. Such ink which penetrates or drips into that gap causes the mechanism to gum and may lead to malfunction and, in limiting cases, to inoperability.

It has already been proposed—see U.S. Pat. No. 1,825,999—to prevent escape of ink between the backing plate and the doctor by the specific construction of the trough system. The various elements to control the nip between the doctor blade and the duct roller are located beneath the duct roller. If ink is used which is comparatively liquid, ink dropping off the duct roller may contaminate the adjustment elements located therebeneath. Such ink which in the course of time will accumulate and dry can interfere with proper operation of the adjustment mechanism.

THE INVENTION

It is an object to provide an inking system for printing machines, and more particularly rotary offset printing machines, which is simple and which effectively prevents contamination of a doctor blade adjustment mechanism by ink being transported by an ink duct roller of the inking system.

Briefly, an elongated flexible element is provided which has mutually angled portions, one of which is connected to the bottom plate of the ink trough and the other to the doctor blade at the side thereof remote from the duct roller, thus forming a bridge or closing element to close or bridge the gap between the doctor blade and the ink trough bottom plate and prevent escape of ink downwardly and beneath the bottom plate. The adjustment elements for the doctor blade can then be located in customary fashion beneath the bottom plate of the ink trough, and will be securely and reliably protected against contamination by ink. The flexible element preferably is a unitary plastic strip having the two angled plate-like portions, which are resiliently deformable to accept differences in adjustment position of the doctor blade at respective selected zones with respect to the bottom plate.

In a preferred form of the invention, an additional ink deflection plate or apron can be secured to the doctor blade to protect and cover attachment and adjustment screws and prevent splashing of ink thereagainst, so that any possible contamination by splashing ink can be prevented.

The arrangement has the advantage that it can be inexpensively constructed, the zone adjustment screws are positioned beneath the ink trough or the bottom plate thereof, and behind the elastic plate-like element or rail, and that they are effectively protected against ink which might drip or splash as it is picked up by the duct roller.

The arrangement has the additional advantage that it lends itself to a construction permitting an extremely exact adjustment of the ink zone by using threaded engagement plates or blocks into which the adjustment screws are threaded, and wherein the engagement threads or blocks, and the corresponding portions of the adjustment screws, have threads of different pitch or direction of pitch.

DRAWINGS

Figure 2:
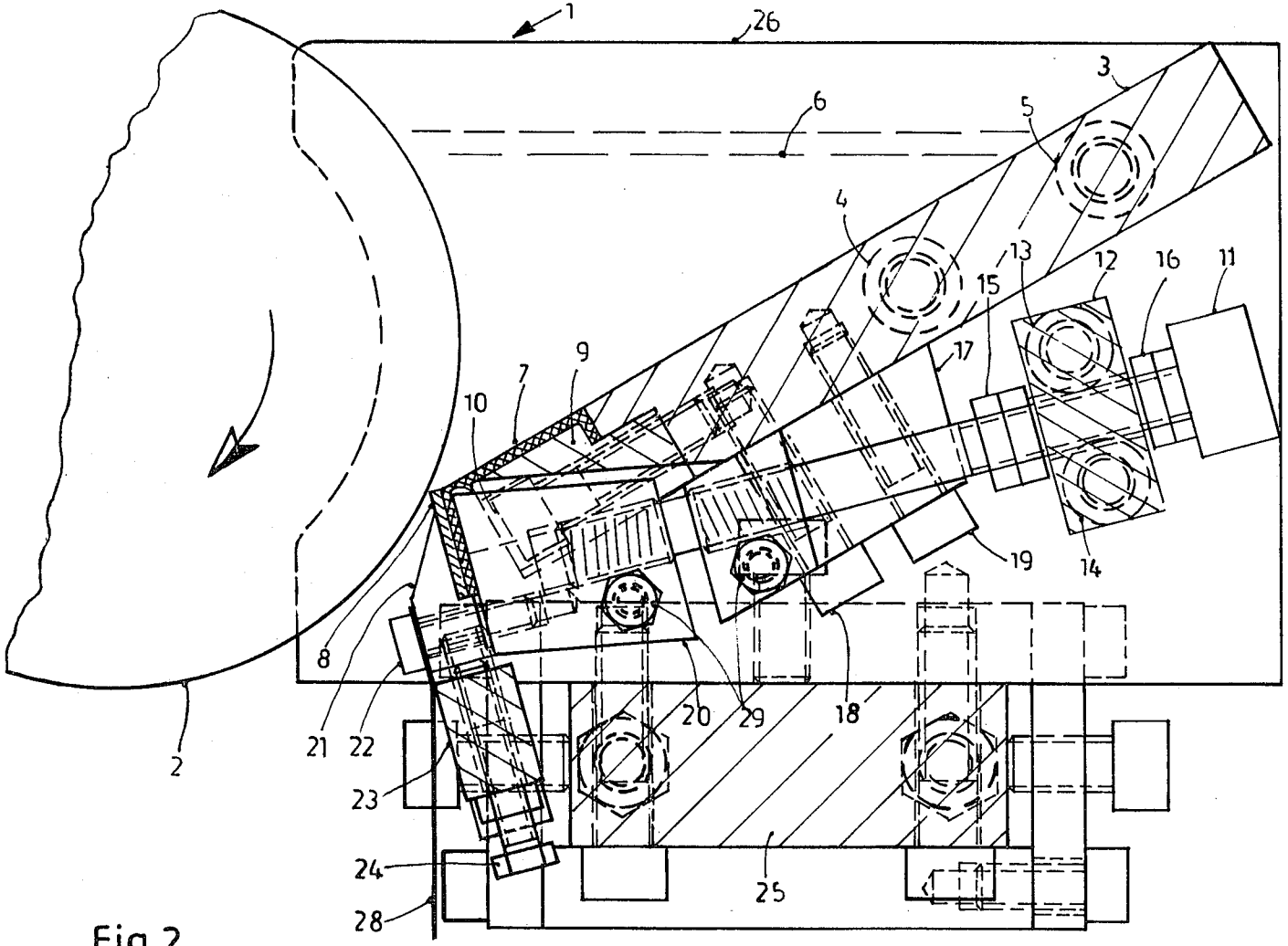

FIG. 1 is a highly schematic front view of the ink trough for a rotary offset printing machine, in which portions thereof have been simplified to facilitate the illustration; and FIG. 2 is a transverse cross-sectional view, showing conventional elements, in schematic form.

The ink trough 1 is an elongated box-like structure positioned parallel to the axis of a duct roller 2. The lower portion of the trough 1 is defined by a bottom plate 3, secured by screws 4, 5 in side walls 26, 27 (FIG. 1). Ink 6—see FIG. 2, to which reference is preferably made—is applied to the duct roller 2, as well known, and in any customary manner, to ink the surface of the duct roller upon rotation thereof in the direction of the arrow—FIG. 2.

The thickness of the ink film on duct roller 2 is determined by a doctor blade 8. To bridge the gap between the doctor blade 8 and the bottom plate 3, and to permit movement of the doctor blade 8 in a direction left-right in FIG. 2, an elastic bridging rail or bridging element 7 is provided. Bridging element 7—see FIG. 2—preferably is made of plastic. The bridging element 7 is angled, formed with two plate-like portions, one of which is directed downwardly and connected with the doctor blade 8 with respect to duct roller 2—behind the doctor blade (see FIG. 2). The connection, for example, may be by adhesion or by a screw connection. The bridging element has depending legs, so that, in cross section, it is essentially U-shaped. It 7 is secured to the bottom plate 3 by one of the legs, for example by a clamping rail 9 extends over the entire width of the trough and clamps the one leg between the rail and a shoulder on plate 3. The rail 9 is secured to the bottom plate 3 by screws 10 (FIG. 2). A plurality of such screws are provided, staggered longitudinally with respect to the bridging rail 7 to securely attach the bridging element 7 by the rail 9 to the bottom plate 3.

Ink 6 (FIG. 2), picked up by the duct roller 2 upon rotation thereof, is conducted through the nip or gap between the doctor blade 8 and the surface of the duct roller 2, but no ink can escape behind the doctor blade 8 even though the doctor blade 8 is moved towards the left (FIG. 2) essentially in engagement with the surface of roller 2, so that the upper edge of the doctor blade 8 defines a minimum gap only.

The gap can be changed in order to adjust the thickness of the film of ink being picked up by the duct roller 2 by zone adjustment screws 11. Screws 11 are guided in a guide rail 12 which is attached at the lateral sides by screws 13, 14. The adjustment range of the screws 11 is determined by counter nuts 15, 16, screwed thereon.

The bottom plate 3 has threaded blocks 17 secured thereto positioned in the region of the respective adjustment screws 11. The threaded blocks 17 are attached to bottom plate 3 by screws or bolts 18, 19. The terminal portions of the adjustment screws 11 are seated in a blind tapped bore of a movable threaded plate 20. The threaded plate 20, in combination with a clamping block 21, clamps the doctor blade 8 in position.

In a preferred form, the ink zone adjustment screws 11 have two thread portions of different pitch, preferably of different direction of pitch or threading. For example, the block 17 may have a left-hand thread thereon, and the threads in the plate 20 may have right-hand orientation. The diameters of the adjustment screws 11 may become smaller towards the left-hand portion thereof to permit ready insertion and threading.

The clamping element 21 is secured to the plate 20 by screws 22, and clamps the doctor blade 8 and with it the plate portion of the flexible resilient element 7 thereon. The localized exact guidance of ink zone adjustment screws and the oppositely directed threads permit precise adjustment of the doctor blade 8, so that the thickness of the film of ink on the duct roller 2 can be adjusted precisely in zones extending axially across the duct roller. No ink can penetrate below the bottom plate even if in selected positions the screws 11 control the doctor blade 8 to be close to the duct roller, and spaced from the bottom plate.

Screws 24, secured in a transverse rail 23 and positioned for engagement with the plate elements 20, provide for additional support of the doctor blade 8, the blade 20, and the clamping elements 21 from below. The blade 8 thus is maintained in adjusted positions at the printing zones—see FIG. 1.

The element 7, preferably of plastic, and formed of two angled plate elements, as an integral unit which can be bent into essentially U-shape, insures that no ink can escape from the ink trough 1 in the direction of the adjustment mechanism. Any ink which might splash off the duct roller 2, or drip off therefrom, must be returned to the location above the bottom plate, or can drip off remote from the adjustment mechanism. Additional protection can be obtained by providing a cover shield plate or apron 28 (FIG. 2) extending parallel to the duct roller 2, and secured by the screws 22 to the doctor blade clamping block 21. The cover plate 28, in combination with the elastic element 7, thus provides complete protection against contamination by possible splashing or dripping ink.

The doctor blade 8 has to be replaced from time to time since it is subject to wear. It can readily be exchanged together with the elastic bridging element 7. The adjustment of the doctor blade 8 is retained. Clamping bolts 29, respectively positioned in the blocks 17 and plates 20 (see FIG. 2) retain the adjustment screws 11 in predetermined alignment position in the respective elements 17, 20 without play, for example by a holding engagement against the bolt, similarly to a tangential set screw.

Various changes and modifications may be made. A suitable plastic material for the element 7 is any flexible plastic which is not attacked by the ink and which can be made with a "living hinge".

I claim:

1. Inking system for a printing machine having
an ink trough (1) including a bottom plate (3);
a duct roller (2) positioned adjacent the bottom plate while leaving a gap with respect to the bottom plate;
a doctor blade (8) extending parallel to the duct roller in said gap to control the thickness of the ink film picked up by the duct roller;
and a plurality of control screws (11) secured to the trough (1), located beneath the bottom plate (3) and transferring adjusting force to the doctor blade to adjust and select the position thereof with respect to the duct roller at selected axial zones of the duct roller by moving the doctor blade in said gap toward and away from the duct roller,
and comprising,
an elongated elastic bridging element (7) for bridging said gap having respectively mutually angled plate portions, of which one plate portion is clamped to the bottom plate and the other plate portion is clamped to the doctor blade at the side thereof remote from the duct roller (2), said bridging element preventing escape of ink from above the bottom plate through a gap between the doctor blade and the bottom plate and to the region of the control screws.

2. System according to claim 1, wherein said bridging element (7) is a unitary resiliently deformable element capable of accepting differences of adjustment position of the doctor blade at respectively selected zones with respect to the bottom plate (3).

3. System according to claim 1, further including a clamping rail (9) located adjacent the bottom plate, said clamping rail being positioned for engagement with said one plate portion of the bridging element (7), and being clamped to the bottom plate to clamp said one plate portion of the bridging element to the bottom plate.

4. System according to claim 1, wherein said elongated elastic bridging element (7) is adhesively attached to the doctor blade.

5. System according to claim 1 or 2 or 3 or 4, wherein said elongated bridging element comprises a plastic element.

6. System according to claim 1, further comprising an adjustment mechanism for adjustably positioning said doctor blade including threaded holding blocks (17) secured to the trough;
threaded plate elements (20) secured to the doctor blade (8);
said adjustment screws (11) being threaded into said blocks and into said plate elements, the direction of the pitch of the threads into said blocks and into said plate elements, and the matching portions of said adjustment screws being in respectively opposite direction.

7. System according to claim 6, further including clamping blocks (21) clamping, the doctor blade to said plates.

8. System according to claim 6, wherein said plates are formed with blind bores, and said holding blocks (17) have through-bores, the direction of pitch of the threads in said holding blocks and said plate elements being, respectively, counter each other.

9. System according to claim 6, further including a support rail (23) extending transversely across the trough (1), and support bolts (24) threaded into the support rails and extending towards the doctor blade.

10. System according to claim 1, further including a splash plate (28) extending parallel to said duct roller (2) and positioned between the doctor blade (8) and the duct roller (2) at a portion below the nip between the doctor blade and the duct roller to provide a splash shield.

11. System according to claim 9, including splash shield or apron (28) located at the side of the doctor blade (8) facing the duct roller (2), extending parallel to the duct roller and located below the nip between the doctor blade and duct roller and depending over and covering at least said support rail and support bolts.

12. System according to claim 1, wherein said elongated elastic bridging element (7), in cross section, is essentially U-shaped;

a clamping rail (9) is provided, located adjacent the bottom plate, the bottom plate being formed with a shoulder between which, and the clamping rail, one of the legs of the U-shaped bridging element is clamped, the other leg of the U-shaped bridging element (7) being positioned adjacent the doctor blade, the connecting portion of the U-shaped bridging element, between the legs, covering said rail (9) and additionally bridging said gap.

* * * * *